United States Patent [19]

Watson

[11] 4,001,911

[45] Jan. 11, 1977

[54] MANUALLY OPERATED ROTARY SEWER CLEANOUT DEVICE

[76] Inventor: Clyde W. Watson, 1916 SE. 6th Ave., Mineral Wells, Tex. 76067

[22] Filed: July 9, 1975

[21] Appl. No.: 594,607

[52] U.S. Cl. ..... 15/104.3 SN; 15/104.09

[51] Int. Cl.[2] ..... B08B 9/02

[58] Field of Search ..... 15/104.05, 104.09, 104.15, 15/104.16, 104.3 R, 104.3 SN; 56/400.02; 172/349

[56] References Cited

UNITED STATES PATENTS

| | | | |
|---|---|---|---|
| 1,911,535 | 5/1933 | Schultze | 56/400.02 |
| 2,188,644 | 1/1940 | Short | 172/349 |
| 2,818,591 | 1/1958 | Joynes | 15/104.15 X |

*Primary Examiner*—Edward L. Roberts
*Attorney, Agent, or Firm*—Wayland D. Keith

[57] ABSTRACT

The present sewer pipe cleaning device may be used on a conventional plumber's fish tape. The device comprises a rowel-like member having curved tines thereon, with the axis of the rowel-like member being transverse to the axis of the sewer line. The rowel-like members are rotatable mounted on a non-rotatable member in such manner that the rowel-like member may be moved into the debris which is clogging the sewer pipe. The rowel-like members each have a plurality of curved, sharpened tines, secured thereto which tines extend in the same direction, with the tines of each rotatable member lying in a plane perpendicular to the axis of the respective rowel-like member. The rotatable members are spaced apart so they will rotate in apertures in flanges on the mounting member, when moved in one direction. The device is so constructed, that reversal of the movement of the fish tape, will lock rowel-like members against rotation, so the debris which has been engaged by the tines can be pulled to the opening of the sewer line and removed as the tape is removed.

7 Claims, 5 Drawing Figures

MANUALLY OPERATED ROTARY SEWER CLEANOUT DEVICE

SUMMARY OF THE INVENTION

This invention relates to improvements in pipe cleaning devices and more particularly to sewer pipe cleaning devices. Various pipe cleaning devices have been proposed heretofore but these for the most part, tended to loosen only the material in the center portion of the pipe so it could be washed downward into the main sewer line. So far as known, neither hand operated or power operated sewer cleaning devices, which have been proposed, retrieve roots and fibrous material from the sewer line at the place of insertion once the line has become clogged but instead would push the material on down the sewer line which was likely to compound the stoppage.

An object of this invention is to provide a sewer line cleaner that is attached to a plumber's fish tape, by means of bolts, which sewer cleaner may be readily run into the sewer line which cleaning device has a rowel-like members thereon. The axis of the rowel-members are transverse to the axis of the longitudinal pipe being cleaned, each rowel-like member has curved tines secured thereto. The rowel-like member will roll as it goes into the sewer line, the curved tines which will be locked against rotation upon retrogression of the rowel-like members, thereby, enabling the debris to be removed from the sewer line as the tape is removed therefrom.

Another object of this invention is to provide a sewer line cleaner, the axis of which is transverse to the axis of the sewer line, the rowel-like members of which cleaner will readily roll into a sewer line and upon retrogression will lock to move the debris toward the place of insertion as the cleaner is removed from the sewer line.

Another object of the invention is to provide a rowel-like member with a plurality of curved tines thereon which may be attached to the end of a plumber's fish tape and rolled into a sewer line, then upon retrogression of the tape with the cleaner device thereon, the rowel-like member will lock, so the curved tines thereof will engage the roots and other debris, thereby enabling the debris to be removed.

Yet another object of the invention is to provide a sewer line cleaning device, the axis of which is transverse to the axis of the sewer line, which cleaning device has a rotatable member having curved tines thereon, which cleaner member may be rotated into the sewer line to loosen and attach to itself the debris, the rotating member may then be locked against rotation and the movement of the tape reversed, which will move the debris clogging the line to the opening thereof where it can be readily removed.

Still a further object of the invention is to provide a sewer cleaner that is low in the cost of manufacture, easy and effective to use and simple in construction.

With these objects in mind and others which will become manifest as the description proceeds reference to be had to the accompanying drawings in which like reference characters designates like parts in the several views thereof in which:

IN THE DRAWINGS

Figures 1, 2, 3, 4, 5:
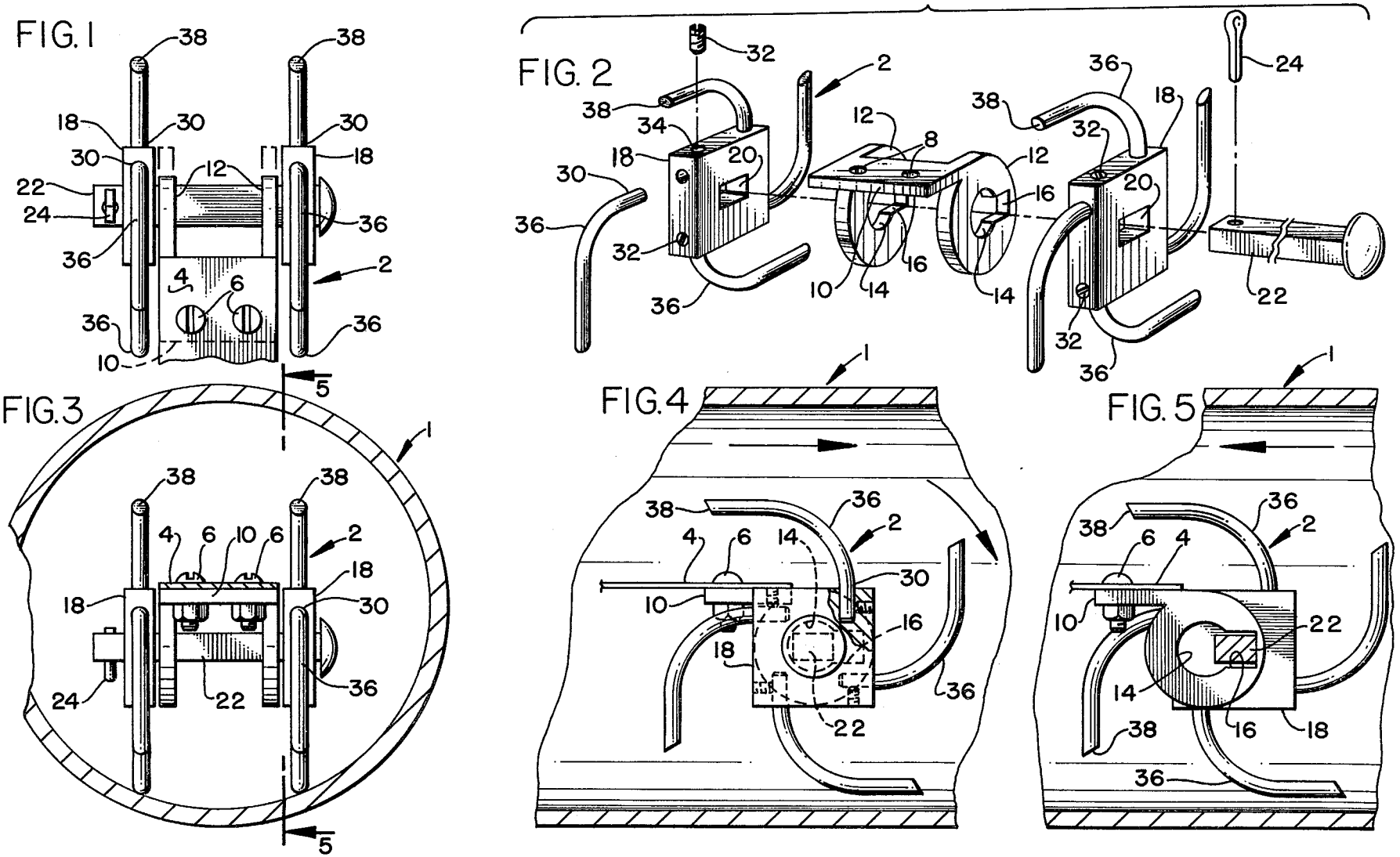
FIG. 1 is a top plan view of the invention shown in full outline as it is being removed from a sewer line, showing a fragmentary portion of a fish tape attached thereto, the dashed outline indicating the movement of the hub for moving the sewer cleaning device into a sewer line.
FIG. 2 is an exploded perspective view of the several parts of the sewer cleaning device with parts broken away and shortened.
FIG. 3 is a cross sectional view through a sewer line pipe showing the sewer cleaning device therein and showing a fish tape secured thereto as by bolts.

FIG. 4 is a elevational view of the sewer cleaning device being moved into a sewer line in the direction indicated by the large arrow and with the sewer cleaning rowel being rotated as indicated by the small arrow, parts of axial member being shown in dotted outline to show how the rowels rotate on a rectangular shaped shaft and FIG. 5 is a view similar to FIG. 4 but of a section taken on line 5—5, FIG. 3, looking in the direction indicated by the arrows, showing the sewer cleaning device being removed from the sewer line and showing the rectangular shaft moved into a notch in the hub so as to lock the rowels against rotation to enable the tines thereof to remove the debris from the sewer line.

DESCRIPTION OF THE PREFERRED EMBODIMENT OF THE INVENTION

With more detailed reference to the drawing, the numeral 1 designates generally a pipe, such as a sewer line, or the like, showing a pipe cleaning device, designated generally by the numeral 2 therein, which cleaning device is attached to a plumber's fish tape 4 by screw threaded bolts 6, which bolts pass through the holes 8 in the tape and in the non-rotatable mounting member 10.

The mounting member 10 tangentially connects to spaced apart, apertured parallel flanges 12, the apertures of which are indicated at 14. One side of each aperture has a keyway-slot 16 therein, which key-way slots are in aligned relation. The flanges 12 are spaced apart on the mounting member 10 and are made integral therewith, tangentially thereto, as will best be seen in FIGS. 2 and 5.

The device is for use by individuals or plumbers to free clogged pipes or sewer lines of debris, roots, fibrous material, or the like. A pair of rotatable members 18, each having a polygonal hole 20 formed therein centrally thereof, and transversely therethrough to receive a complementary polygonal pin 22 therethrough in through the central apertures 14 and the respective apertured flanges 12, with the pin 22 extending transversely through the second rotatable member 18 with a pin, such as a cotter pin 24 extending transversely through the pin 22 exterior of the rotatable member 18 as will best be seen in FIGS. 1 and 3 so as to hold the rotatable members 18 in close fitting relation to the flanges 12 as will best be seen in FIGS. 1 and 3.

The rotatable members 18, in the present instance, are shown to be square and have holes drilled in the edges thereof a spaced distance inward from the corners thereof on the sides of the respective rotatable members 18, each which holes is of a depth to receive the end of a tine 30. The hole may be round or polygonal, and when the respective tines are complementally fitted in place, as will best be seen in FIGS. 2 and 4, a set screw 32 is threadably received into a hole 34 near each corner of each member 18 so as to intersect the holes 26 therein to fixedly secure the tine 30 in secure relation within the rotatable members 18. Each tine 30 extends upward and is curved, as indicated at 36 and lies in a plane passing through the holes in the rotatable member 18. The end of each tine is shown to be sharpened, as indicated at 38, so it will engage debris when the member 18 is being removed from the pipe as indicated in FIG. 5. The polygonal pin 22 is shown to be rectangular in cross section with a diagonal dimension across the opposite corners being slightly less than the diameter of the hole 14 in the apertured flanges 12. This will enable the pin 22 to be moved into position as shown in FIG. 4 when the sewer cleaning device 2 is moved into the sewer line or the like, as indicated in FIG. 4. This will enable the sewer line cleaning device 2 to rotate about the polygonal pin 22 as an axis as the device is moved into the sewer line 1 with the curved portions 36 of the tines 30 not engaging the debris in the sewer line 1 until the cleaning device is moved the desired distance in the line, at which time, the plumbers fish tape 4 is pulled which will move the mounted device 10 to the position as shown in FIGS. 1 and 5 with the polygonal pin 22 being moved into the keyway slots 16 which will lock the mounting device, having the flanges 12 thereon, integral with the rotatable members 18, whereupon the curved portions 36 of the tines 30 will engage debris which will enable the plumber's fish tape 4 to be pulled thereby removing sewer cleaning device 2 from the sewer line together with the debris which the tines 30 has engaged.

If it is desired to free the cleaning device it may be moved in the direction indicated by the arrow in FIG. 4, which will permit polygonal pin 22 to move into the round apertures 14 in the respective flanges 12, then the direction may be reversed as indicated by the arrow in FIG. 5 to lock the rotatable members 18 with the flanges 12 so the flanges 12, which connect with the mounting plate 10, may be moved in the direction indicated by the arrow in FIG. 5. In this manner, the sewer line may be thoroughly cleaned of debris, such as roots, strings, and the like, without the use of an expensive power operated cleaner, as the present device uses conventional plumber's fish tape and although it may be twisted from side to side, if desired, but it is not completely rotated in the manner of a power driven rotary cleaner for a sewer pipe.

The tines 30 are preferably made of spring steel, so in event the cleaning device becomes stuck or lodged within the sewer line or the like, the tines are of such flexibility that they will yield to permit the pipe cleaning device 2 to be removed by applying a greater amount of pull thereto. Any of the tines that are bent or broken may be readily replaced by removing set screw 32 and removing the tine 30 from the hole 26, and then a new tine inserted therein and secured thereto. The tines are relatively inexpensive, therefore the device may be used economically either by individuals or by commercial plumbers.

What is claimed is:

1. A manually operated cleanout device for pipes, comprising:

a. a mounting member for attachment to a plumber's fish tape,
   1. said mounting member adapted to be moved longitudinally in a pipe by the plumber's fish tape,
   2. said mounting member having a pair of spaced apart parallel flanges mounted thereon and fixedly secured thereto and substantially tangential to a side of said flanges,
   3. each said flanges having a hole formed therein, which said holes are in aligned transverse relation and the axes thereof being transverse to the longitudinal axis of the pipe,
   4. each said flanges having a slot formed therein and connecting with the rear side of each said holes in said flange, b. a pair of rotatable members having a polygonal hole formed therein fitted on the outer side of said respective flanges so the polygonal hole will be in aligned relation with said holes in said flanges, c. a polygonal pin passing through the polygonal holes in said rotatable members and through said holes in said flanges,
   1. a pin passing through said polygonal pin near the end of said pin to retain said polygonal pin against longitudinal movement,
   2. said dimension across the corners of said polygonal pin being less than the diameter of the hole in said respective flanges so said rotatable members will rotate about the axes of said holes in said flanges when moved in one direction,
   3. said slots in communication with said holes in said flanges adapted to complementally receive a portion of said polygonal pin therein when said rotatable member is moved in the opposite direction, d. curved tines mounted on said rotatable member,
   1. said tines extending outwardly and each being curved in the same direction, with a portion of each tine extending outwardly from said curved portion having a sharpened end thereon,
   2. means fixedly securing said tines in said rotatable member, e. fastening means to secure a plumber's fish tape to said mounting means.

2. A manually operated pipe cleanout device, which device comprises;

a. a non-rotatable, mounting member for attachment to a plumber's fish tape for longitudinal movement in a pipe, b. a rotatable member having outstanding tines thereon, which member is mounted on said mounting member for rotation in the pipe, when said mounting member is moved in one direction,
   1. locking means to restrain said rotatable member against rotation when said mounting member is moved in the opposite direction, c. the axis of said rotatable member is transverse to the longitudinal axis of the pipe, d. each said tine on said rotatable member has a portion thereof curved, which curved portions of said tines extend in the direction to rotate counter to the direction of rotation of said rotatable member.

3. A manually operated pipe cleanout device as defined in claim 2; wherein a. said rotating member has an aperture formed therein, b. said locking means to restrain said apertured rotatable member against rotation in one direction is a pin fixedly secured to and rotatable with said rotatable member within the aperture in said mounting member, when in one position, c. said aperture in said mounting member being engageable with said pin when said pin is moved laterally within the aperture in said mounting member to restrain said pin and said rotarable member against rotation, when in another position, to enable debris to be removed from the pipe.

4. A manually operated pipe cleanout device, as defined in claim 3; wherein a. said mounting member has spaced apart flanges thereon, each said flange is at a right angle to said mounting member to which the plumber's fish tape is attached, 1. each said flange having an aperture formed therein, each which aperture is generally of round configuration, but having a communicating slot formed in the rear side thereof,
2. the axes of said apertures are transversely aligned,
3. the axes of said apertures are transverse to the longitudinal axis of the pipe,
4. the communicating slots being in transverse alignment, b. said pin being polygonal in shape, which pin passes through the apertures in said rotatable member, 1. said polygonal pin being rotatable with said rotatable member and being rotatable within said round portion of each said aperture in said flange, when said mounting member is moved in one direction,
2. said polygonal pin adapted to engage within the slot in each said flange when said mounting member is moved in the opposite direction so as to perform said locking action with said rotatable member and said outwardly extending, curved tines to engage debris within the pipe when the plumber's fish tape and said non-rotatable mounting member are moved longitudinally toward the opening in said pipe.

5. A manually operated pipe cleanout device as defined in claim 4; wherein a. said flanges on said mounting member are in tangential relation thereto.

6. A manually operated pipe cleanout device as defined in claim 2; wherein a. said rotatable member comprises a pair of spaced apart member portions on said locking means, 1. each portion of said rotatable member is apertured to complementally engage said locking means and to be rotatable therewith,
2. said locking means is a polygonal pin, b. each portion of said rotatable member has holes formed therein, each hole to receive an end of one of said tines, 1. each portion of said rotatable member has screw threaded holes formed therein, each which hole intersects one of said holes which receives an end of one of said tines,
2. set screw means engaging each said screw threaded hole to fixedly secure said tines in said respective holes.

7. A manually operated pipe cleanout device as defined in claim 2; wherein a. said tines are detachably secured to said rotatable member, b. the leading edge of each said tine is sharpened.

* * * * *